US006750281B2

(12) United States Patent
Hirau et al.

(10) Patent No.: US 6,750,281 B2
(45) Date of Patent: Jun. 15, 2004

(54) GOLF BALL AND METHOD OF MANUFACTURING THEREOF

(75) Inventors: Tsutomu Hirau, Kobe (JP); Hiroaki Tanaka, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 42 days.

(21) Appl. No.: 10/266,597

(22) Filed: Oct. 9, 2002

(65) Prior Publication Data

US 2003/0119605 A1 Jun. 26, 2003

(30) Foreign Application Priority Data

Oct. 9, 2001 (JP) ..... 2001-311232

(51) Int. Cl.[7] ..... A63B 37/06; A63B 37/12

(52) U.S. Cl. ..... 524/406; 524/423; 525/193; 525/201; 525/237; 525/274; 473/371; 473/372

(58) Field of Search ..... 524/406, 423; 525/193, 201, 237, 274; 473/371, 372

(56) References Cited

U.S. PATENT DOCUMENTS 5,050,886 A * 9/1991 Yamagishi et al. ..... 473/372
5,244,955 A 9/1993 Toyoda
5,574,107 A * 11/1996 Hiraoka et al. ..... 525/193
6,139,447 A * 10/2000 Ohama ..... 473/378
6,281,294 B1 * 8/2001 Tanaka ..... 525/274

FOREIGN PATENT DOCUMENTS

| | | | |
|---|---|---|---|
| JP | 8-1020 | A | 1/1996 |
| JP | 8-100081 | A | 4/1996 |
| JP | 9-137000 | A | 5/1997 |
| JP | 11-89968 | A | 4/1999 |
| JP | 2000-350793 | A | 12/2000 |

* cited by examiner

*Primary Examiner*—David J. Buttner
(74) *Attorney, Agent, or Firm*—Birch, Stewart, Kolasch & Birch, LLP

(57) ABSTRACT

A golf ball and a method of manufacturing thereof are provided, the golf ball having a core containing a Mg vulcanized rubber powder crosslinked by a magnesium salt of an unsaturated carboxylic acid and another vulcanized rubber powder crosslinked by a co-crosslinking agent other than the magnesium salt of the unsaturated carboxylic acid. Preferably, the ratio $\alpha/\beta$ between the content $\alpha$ of the Mg vulcanized rubber powder and the content $\beta$ of another vulcanized rubber powder is 1/4 to 4, and the total content $\alpha+\beta$ of the vulcanized rubber powders based on 100 parts by mass of a base rubber of the core is 5 to 30 parts by mass.

4 Claims, No Drawings

GOLF BALL AND METHOD OF MANUFACTURING THEREOF

BACKGROUND OF THE INVENTION

1. Field of the Invention

The present invention relates to golf balls and methods of manufacturing thereof. In particular, the present invention relates to a golf ball having its core with the mold release property (easiness of removal of the core from a mold) improved without deteriorating the performance of the golf ball, and relates to a method of manufacturing such a golf ball.

2. Description of the Background Art

Golf balls are generally classified into thread-wound golf balls and solid golf balls. Any of the golf balls includes a core formed of at least one layer. The core is produced by vulcanization-molding a rubber composition in a mold. As the core has an unsatisfactory mold release property, the mold release property is ensured conventionally by those methods as described below.

According to one method, a silicon-based or fluorine-based mold release agent for example is applied to the surface of a mold, or the mold release agent is applied to a parting film which is provided on the surface of the mold in which a rubber composition is vulcanization-molded. With regard to this method, some cores exhibit the mold release property deteriorated in a short time. In addition, the mold release agent could be left on the surface of the core to hinder the core from adhering to a cover for example formed on the core, resulting in deterioration in the durability of the resultant golf ball. Further, if an additional process is incorporated into the production line in order to remove the mold release agent which is left attached to the surface of the core, a significant capital investment in equipment as well as enormous energy are necessary.

According to another method, the surface of a mold is subjected to surface treatment with a chromium coating. This method is excellent in that no mold release component is attached to the surface of the core while having a problem of the costly surface treatment and a problem that the mold release effect lasts for only a short period of time.

According to still another method, a mold is cooled after the vulcanization-molding to reduce the core in volume thereby facilitating removal of the core from the mold. A problem of this method is that considerable energy is required for cooling the mold after the vulcanization-molding process.

According to a further method, some of the materials constituting the core are changed. For example, Japanese Patent Laying-Open No. 8-100081 discloses a method of facilitating removal from the mold by adding a quinone-based compound for example to an ethylenic unsaturated nitrile-conjugated diene-based copolymer rubber composition. Japanese Patent Laying-Open No. 9-137000 discloses a method according to which a sulfur or phosphorous element-containing ion surface-active agent is added, and U.S. Pat. No. 5,244,955 discloses a method according to which a metal salt of higher fatty acid with at least 6 carbon atoms is added.

These methods could deteriorate the performance, resiliency for example, of golf balls. Moreover, the cost of golf ball products could increase if a costly material like the internal mold release agent as disclosed in Japanese Patent Laying-Open No. 9-137000 or U.S. Pat. No. 5,244,955 is employed.

SUMMARY OF THE INVENTION

One object of the present invention is, in view of the above-discussed circumstances, to provide a golf ball having a core with an improved mold release property without deterioration in such performance of the golf ball as resiliency, and to provide a method of manufacturing the golf ball.

The present invention is, with the purpose of achieving the above-described object, a golf ball having a core containing a vulcanized rubber powder crosslinked by a magnesium salt of unsaturated carboxylic acid (hereinafter "Mg vulcanized rubber powder") and a vulcanized rubber powder crosslinked by a co-crosslinking agent other than the magnesium salt of the unsaturated carboxylic acid (hereinafter "another vulcanized rubber powder").

Preferably, the ratio $\alpha/\beta$ between the content $\alpha$ of the Mg vulcanized rubber powder and the content $\beta$ of another vulcanized rubber powder is 1/4 to 4, and the total content $\alpha+\beta$ of the vulcanized rubber powders based on 100 parts by mass of a base rubber of the core is 5 to 30 parts by mass.

Preferably, the Mg vulcanized rubber powder contains, based on 100 parts by mass of the base rubber, 5 to 40 parts by mass of magnesium methacrylate, 1 to 50 parts by mass of at least one of tungsten, tungsten oxide and barium sulfate, and 0.1 to 5 parts by mass of organic peroxide.

The golf ball as discussed above is manufactured by blending the Mg vulcanized rubber powder with another vulcanized rubber powder to produce a core of the golf ball.

DESCRIPTION OF THE PREFERRED EMBODIMENTS

The present invention is hereinafter described in detail. According to the present invention, a golf ball is produced by forming a core in which a Mg vulcanized rubber powder and another vulcanized rubber powder are blended and surrounding the core with a cover for example.

[Mg Vulcanized Rubber Powder]

According to the present invention, a Mg vulcanized rubber powder is composed of a base rubber, a crosslinking agent, a co-crosslinking agent and a filler for example.

The base rubber is a natural rubber, a synthetic rubber or a mixture thereof. Examples of the synthetic rubber are polybutadiene rubber, polyisoprene rubber, styrene polybutadiene rubber, and ethylene-propylene-diene rubber, for example. A particularly preferable one of the synthetic rubbers is a high cis polybutadiene rubber having at least 40%, preferably at least 80% of cis-1,4 content, since the high cis polybutadiene rubber is superior in the resiliency.

The crosslinking agent used here is an organic peroxide for example, and examples of the organic peroxide are dicumyl peroxide, 1,1-bis(t-butylperoxy)-3,3,5-trimethylcyclohexane, 2,5-dimethyl-2,5-di(t-butylperoxy) hexane, and t-butyl peroxide, for example. An appropriate one of them is dicumyl peroxide. Preferably, per 100 parts by mass of the base rubber, 0.1 to 5 parts by mass of the organic peroxide is blended with the base rubber. If the content of the blended organic peroxide is less than 0.1 parts by mass, a resultant golf ball is too soft which deteriorates the resiliency and thus decreases the carry of the golf ball, while the content of the blended organic peroxide exceeding 5 parts by mass makes the golf ball hard which impairs the shot feel.

The co-crosslinking agent used here is a magnesium salt of unsaturated carboxylic acid. Examples of the magnesium salt of the unsaturated carboxylic acid are magnesium acrylate and magnesium methacrylate, for example, and the magnesium salt of methacrylic acid is suitably used. Per 100 parts by mass of the base rubber, 5–40 parts by mass, preferably 10–40 parts by mass of the magnesium salt of the unsaturated carboxylic acid is blended with the base rubber. If the content of the co-crosslinking agent is less than 5 parts by mass, the crosslinking density decreases to impair the resiliency of the resultant golf ball. If more than 40 parts by mass of the co-crosslinking agent is blended, the increased crosslinking density makes the Mg vulcanized rubber powder hard, and consequently, the shot feel of the resultant golf ball tends to deteriorate. Here, an unsaturated carboxylic acid and a magnesium oxide may separately be blended to produce a rubber composition so that the resultant rubber composition contains the magnesium salt of the unsaturated carboxyic acid therein. An acrylic acid or methacrylic acid is suitably used as the unsaturated carboxyic acid.

The filler according to the present invention may be any which is normally used for the core. At least one of tungsten, tungsten oxide and barium sulfate is suitably used as the filler. Preferably, per 100 parts by mass of the base rubber, 1–50 parts by mass of the filler is blended with the base rubber. The content of the filler exceeding 50 parts by mass increases the mass of the core and accordingly makes the golf ball heavy. In addition, as any of the above-mentioned materials has a relatively high specific gravity, the amount of the filler to be blended with the base rubber may be reduced so as to lessen deterioration of the resiliency of the golf ball. As a filler for the rubber, instead of the fillers as described above, such a filler containing no zinc as calcium carbonate, titanium oxide, clay and diatomaceous earth may be used.

[Preparation of Mg Vulcanized Rubber Powder]

The Mg vulcanized rubber powder is prepared by preparing a rubber composition and vulcanizing the resultant rubber composition to produce a vulcanized rubber which is then crushed into the Mg vulcanized rubber powder.

The rubber composition of the Mg vulcanized rubber powder is prepared by measuring out required amounts respectively of the above-described base rubber, crosslinking agent, co-crosslinking agent and filler for example, and kneading them by means of an appropriate kneading machine like a roll mill, kneader or Banbury mixer.

Vulcanization is accomplished following a conventional method. For example, the rubber composition is set within a mold to have a predetermined shape or supplied into the mold by an injection molding machine so that the mold is filled with the rubber composition which is then vulcanized under a temperature condition of 130 to 180° C. for 10 to 60 minutes. The vulcanized rubber composition is then cooled to approximately room temperature to produce a vulcanized rubber.

The vulcanized rubber is crushed following a conventional method. Preferably, the vulcanized rubber is roughly crushed by means of such a known crusher as shredder and then a screw feeder for example is used to supply a constant amount of the roughly crushed vulcanized rubber to a pulverizer which is disclosed in Japanese Patent Laying-Open No. 8-1020 for example and accordingly pulverize the vulcanized rubber into fine powder. The vulcanized rubber to be crushed and pulverized is not limited to the one obtained as described above. In consideration of recycle, any golf balls regarded as defectives due to lack of volume for example as well as spews extruded from molds in the vulcanization molding process of the manufacturing process, for example, may preferably be used for the vulcanized rubber to be crushed.

The grain size (diameter) of the Mg vulcanized rubber powder is not limited to a particular one. Preferably, the grain size of the powder is 3 mm or less and more preferably 1 mm or less.

[Another Vulcanized Rubber Powder]

According to the present invention, another vulcanized rubber powder refers to a vulcanized rubber powder which is crosslinked by a co-crosslinking agent other than the magnesium salt of the unsaturated carboxylic acid. Specifically, another vulcanized rubber powder is composed of a base rubber, a crosslinking agent, a co-crosslinking agent and a filler for example, and the base rubber, crosslinking agent and filler are materials similar to those of the Mg vulcanized rubber powder.

The co-crosslinking agent of another vulcanized rubber powder is not limited to a specific one if the co-crosslinking agent is not the magnesium salt of the unsaturated carboxylic acid. Examples of the co-crosslinking agent here are unsaturated carboxylic acid, metal salts except for magnesium salt of unsaturated carboxylic acid, polyfunctional monomer, and phenylenebismaleimide. Among them, such zinc salts of unsaturated carboxylic acid as zinc acrylate and zinc methacrylate are preferably used. The vulcanized rubber powder crosslinked by a zinc salt of unsaturated carboxylic acid (hereinafter "Zn vulcanized rubber powder") included in the core is preferable in terms of the resiliency of the golf ball.

In addition, another vulcanized rubber powder is prepared by a method similar to that for the Mg vulcanized rubber powder as described above. Specifically, a rubber composition is prepared that is vulcanized to produce a vulcanized rubber which is then crushed into powder.

[Core]

The core of the golf ball according to the present invention may include, in addition to the Mg vulcanized rubber powder and another vulcanized rubber powder as discussed above, a base rubber, a crosslinking agent, a co-crosslinking agent and a filler for example.

Here, if the core contains the Mg vulcanized rubber powder, the core exhibits an improved mold release property, i.e., easier removal of the core from a mold, since the adhesion between the mold surface, particularly iron oxide constituting the mold surface and the magnesium salt contained in the Mg vulcanized rubber powder is weaker relative to that between the mold surface and a zinc salt. If another vulcanized rubber powder is contained in the core, the resiliency for example of the golf ball is improved.

Preferably, the ratio $\alpha/\beta$ between the content $\alpha$ of the Mg vulcanized rubber powder in the core and the content $\beta$ of another vulcanized rubber powder crosslinked by a material except for the magnesium salt of the unsaturated carboxylic acid in the core is 1/4 to 4, and more preferably 1/2 to 4. If the content ratio is lower than 1/4, the mold release property of the core could deteriorate while the resiliency of the golf ball could deteriorate if the ratio is higher than 4.

If the core contains both of the Mg vulcanized rubber powder and the vulcanized rubber powder crosslinked by a co-crosslinking agent except for the magnesium salt of the unsaturated carboxylic acid, the total content $\alpha+\beta$ of the vulcanized rubber powders based on 100 parts by mass of the base rubber of the core is preferably 5 to 30 parts by mass, and more preferably 10 to 30 parts by mass. If the total content of the vulcanized rubber powders is less than 5 parts by mass, the mold release property of the core deteriorates, while the total content thereof exceeding 30 parts by mass deteriorates the resiliency of the golf ball and further deteriorates the workability in kneading of the rubber composition of the core by means of a roll mill.

Here, the core may be formed of only one layer or may be formed of at least two layers. If the core is formed of two or more layers, the Mg vulcanized rubber powder may be contained in the layer to be in contact with the mold in the vulcanization process and another or other layers may or may not contain the Mg vulcanized rubber powder.

The base rubber of the core according to the present invention is not limited to a particular material. Polybutadiene is preferably used and another rubber such as isoprene rubber, natural rubber or styrene butadiene rubber for example may be blended with the base rubber.

In addition, as a crosslinking agent, such an organic peroxide as dicumyl peroxide may be contained in the core. As a co-crosslinking agent, an unsaturated carboxylic acid or a metal salt thereof for example may be blended in the core. Further, as a filler, such an inorganic filler as a metal oxide or a metal of high specific gravity may be blended in the core.

[Production of Core]

After the rubber composition is prepared, the rubber composition is vulcanized to produce the core.

The rubber composition of the core is prepared by measuring out required amounts respectively of the base rubber, Mg vulcanized rubber powder, another vulcanized rubber powder, crosslinking agent, co-crosslinking agent and filler for example and kneading them by means of an appropriate kneading machine like a roll mill, kneader or Banbury mixer.

Vulcanization is accomplished by a conventional method. For example, the rubber composition is placed in a mold for example to be vulcanized under a temperature condition of 130 to 180° C. for 10 to 60 minutes. Here, a cavity of the mold used for molding the core has its surface to be in contact with the core to be molded, and at least this surface may be made of an iron-based metal such as stainless steel and carbon steel, in consideration of the durability, anticorrosion, cost, and thermal conductivity of the mold for example.

The rubber composition thus vulcanized is then cooled to approximately room temperature to produce the core. According to the present invention, the core contains the Mg vulcanized rubber powder so that the core has an improved mold release property and thus the core having been cooled is easily removed from the mold. Consequently, the production efficiency of golf balls is enhanced.

Moreover, if the core is formed of two layers, i.e., an inner layer and an outer layer, the core is vulcanized by a method as disclosed in Japanese Patent Laying-Open No. 2000-350793 for example. A hemispheric mold with a hemispheric cavity and a core mold having a hemispheric protrusion in the same shape as that of the core are used so as to produce the outer layer, and then covering the inner layer with the outer layer by means of a mold for the core.

[Production of Cover]

The surface of the core thus produced is surrounded with a cover or surrounded with a cover with a rubber-thread layer therebetween.

The cover is formed of one layer or at least two layers. The material for the cover is not limited to a particular one. Any of various conventional cover materials may be used for the cover. For example, the base resin of the cover may be a resin composition containing one or at least two of thermoplastic resins, particularly such thermoplastic resins as ionomer resin, and polyester, polyurethane, polyolefin or polystyrene-based thermoplastic resin. In addition, an inorganic filler and a pigment for example may appropriately be blended with the resin.

The cover is used to wrap the core according to any method usually employed. For example, the cover composition as described above is molded in advance into hemispheric half shells. Two half shells are used to envelope the core which is accordingly pressure-molded. Alternatively, the cover composition as described above is directly injection-molded onto the core to envelop the core. From aesthetic and commercial considerations, the golf ball of the present invention is thereafter finished with paint and marked with a stamp for example to be brought to the market.

EXAMPLES

The present invention is now described further in detail in connection with examples, however, the present invention is not limited to these examples.

(1) Preparation of Vulcanized Rubber Powder

The rubber compositions to be contained in vulcanized rubber powders with their makeup as shown in Table 1 were kneaded by a kneader having a capacity of 10 liters. The resultant rubber compositions were each sheeted by an open roll mill and then pressing vulcanized at 165° C. for 18 minutes to produce a sheet-shaped vulcanized rubber. The vulcanized rubbers were thereafter processed by a crusher into chips of 3–10 mm each. Then, the chip-shaped vulcanized rubbers were pulverized by a known pulverizer as disclosed in Japanese Patent Laying-Open No. 8-1020 for example into a Mg vulcanized rubber powder and a Zn vulcanized rubber powder having an average grain size of 1 mm. Here, respective contents of ingredients in Table 1 are expressed in terms of parts by mass.

TABLE 1

| vulcanized rubber powder | Mg vulcanized rubber powder | Zn vulcanized rubber powder |
|---|---|---|
| polybutadiene(*1) | 100 | 100 |
| magnesium methacrylate | 30 | — |
| zinc acrylate | — | 22 |
| zinc oxide | — | 20 |
| barium sulfate | 25 | — |
| tungsten oxide | 10 | — |
| dicumyl peroxide(*2) | 1 | 1 |
| vulcanization condition | | |
| temp (° C.) | 165 | 165 |
| time (min) | 18 | 18 |
| grain size (mm) | 1 | 1 |

(*1)BR-11 manufactured by JSR Corporation
(*2)Percumyl D manufactured by NOF Corporation

(2) Production of Core and Golf Ball

The Mg vulcanized rubber powder and the Zn vulcanized rubber powder shown in Table 1 were used as ingredients of the rubber compositions shown in Table 2 (Examples 1–4), Table 3 (Examples 5–8), Table 4 (Examples 9–12) and Table 5 (Comparative Examples 1–4). The rubber compositions each with the makeup shown in the tables were kneaded, charged into a mold made of stainless steel, and vulcanized at 160° C. for 25 minutes to produce a core having an outer diameter of 38.5 mm. The core was covered with an outer layer formed of 100 parts by mass of ionomer resin and 2 parts by mass of titanium oxide. Accordingly, a two-piece golf ball having an outer diameter of 42.7 mm was produced. Here, the ingredients shown in Tables 2–5 are each expressed in terms of parts by mass.

(3) Test Method

The kneading workability in the kneading process of the rubber composition of the core, the mold release property of the core after the vulcanization process, and the coefficient of restitution of the finished golf ball were evaluated following the methods detailed below. The outcome of the evaluation is shown in Table 2 (Examples 1–4), Table 3 (Examples 5–8), Table 4 (Examples 9–12) and Table 5 (Comparative Examples 1–4).

(i) Mold Release Property of Core

The mold release property of the core represents the easiness with which the core after the pressing vulcanization process is removed from the mold. The mold release property was evaluated as follows. A mold release agent (DAIFREE GA-6010 manufactured by Daikin Industries, Ltd.) was applied to the mold, and the core after the tenth pressing vulcanization molding was manually removed to evaluate the degree of easiness of mold release on the basis of the following standards.

Evaluation Criteria

A: easily removable by hand(s)

B: need a little manual force but removable by prying out with any hand(s)

C: impossible to remove even with a considerable manual force and removable with the aid of a hammer D: core is stuck firmly in the mold and impossible to remove since use of a hammer could break the core (ii) Coefficient of Restitution The golf ball was collided with a cylindrical object of aluminum weighing 200 g at a speed of 45 m/s, and respective speeds, after collision, of the cylindrical object and the golf ball were measured. The speeds before and after collision and weights of the object and the ball were used to calculate the coefficient of restitution. Twelve golf balls were used for each example and the average coefficient of restitution was calculated for each of examples and comparative examples. The coefficient of restitution is represented by a relative value with respect to the restitution coefficient 100 of the golf ball of Comparative Example 1. The greater the coefficient, more excellent in the resiliency.

(iii) Kneading Workability

The kneading workability represents easiness in the kneading work for the rubber composition of the core. The kneading workability was objectively determined from the state of production.

Evaluation Criteria

A: The rubber composition is closely in contact with the roll to an appropriate degree and accordingly provide good workability.

B: The rubber composition is separated from the roll, resulting in poor workability.

TABLE 2

| | Example | | | |
|---|---|---|---|---|
| | 1 | 2 | 3 | 4 |
| core | | | | |
| polybutadiene(*1) | 100 | 100 | 100 | 100 |
| zinc acrylate | 25 | 25 | 25 | 25 |
| zinc oxide | 20 | 20 | 20 | 20 |
| dicumyl peroxide(*2) | 1 | 1 | 1 | 1 |
| Mg vulcanized rubber powder | 3 | 5 | 10 | 12 |
| Zn vulcanized rubber powder | 12 | 10 | 5 | 3 |
| total content of vulcanized rubber powders | 15 | 15 | 15 | 15 |
| content ratio between vulcanized rubber powders (Mg/Zn) | 1/4 | 1/2 | 2/1 | 4/1 |

TABLE 2-continued

| | Example | | | |
|---|---|---|---|---|
| | 1 | 2 | 3 | 4 |
| cover | | | | |
| ionomer resin(*3) | 100 | 100 | 100 | 100 |
| titanium oxide | 2 | 2 | 2 | 2 |
| performance | | | | |
| mold release of core | B | A | A | A |
| restitution coefficient | 102 | 101 | 101 | 100 |
| kneading workability | A | A | A | A |

TABLE 3

| | Example | | | |
|---|---|---|---|---|
| | 5 | 6 | 7 | 8 |
| core | | | | |
| polybutadiene(*1) | 100 | 100 | 100 | 100 |
| zinc acrylate | 25 | 25 | 25 | 25 |
| zinc oxide | 20 | 20 | 20 | 20 |
| dicumyl peroxide(*2) | 1 | 1 | 1 | 1 |
| Mg vulcanized rubber powder | 2.5 | 2.5 | 5 | 12.5 |
| Zn vulcanized rubber powder | 12.5 | 2.5 | 5 | 2.5 |
| total content of vulcanized rubber powders | 15 | 5 | 10 | 15 |
| content ratio between vulcanized rubber powders (Mg/Zn) | 1/5 | 1/1 | 1/1 | 5/1 |
| cover | | | | |
| ionomer resin(*3) | 100 | 100 | 100 | 100 |
| titanium oxide | 2 | 2 | 2 | 2 |
| performance | | | | |
| mold release of core | C | B | A | A |
| restitution coefficient | 101 | 101 | 100 | 98 |
| kneading workability | A | A | A | A |

TABLE 4

| | Example | | | |
|---|---|---|---|---|
| | 9 | 10 | 11 | 12 |
| core | | | | |
| polybutadiene(*1) | 100 | 100 | 100 | 100 |
| zinc acrylate | 25 | 25 | 25 | 25 |
| zinc oxide | 20 | 20 | 20 | 20 |
| dicumyl peroxide(*2) | 1 | 1 | 1 | 1 |
| Mg vulcanized rubber powder | 10 | 15 | 0.5 | 17.5 |
| Zn vulcanized rubber powder | 10 | 15 | 0.5 | 17.5 |
| total content of vulcanized rubber powders | 20 | 30 | 1 | 35 |
| content ratio between vulcanized rubber powders (Mg/Zn) | 1/1 | 1/1 | 1/1 | 1/1 |
| cover | | | | |
| ionomer resin(*3) | 100 | 100 | 100 | 100 |
| titanium oxide | 2 | 2 | 2 | 2 |
| performance | | | | |
| mold release of core | A | A | C | A |
| restitution coefficient | 101 | 99 | 101 | 98 |
| kneading workability | A | A | A | B |

TABLE 5

| | Comparative Example | | | |
|---|---|---|---|---|
| | 1 | 2 | 3 | 4 |
| core | | | | |
| polybutadiene(*1) | 100 | 100 | 100 | 100 |
| zinc acrylate | 25 | 25 | 25 | 25 |
| zinc oxide | 20 | 20 | 20 | 20 |
| dicumyl peroxide(*2) | 1 | 1 | 1 | 1 |
| Mg vulcanized rubber powder | — | — | — | 15 |
| Zn vulcanized rubber powder | — | 15 | 20 | — |
| total content of vulcanized rubber powders | — | 15 | 20 | 100 |
| content ratio between vulcanized rubber powders (Mg/Zn) | — | 0 | 0 | — |
| cover | | | | |
| ionomer resin(*3) | 100 | 100 | 100 | 100 |
| titanium oxide | 2 | 2 | 2 | 2 |
| performance | | | | |
| mold release of core | C | C | C | B |
| restitution coefficient | 100 | 99 | 99 | 98 |
| kneading workability | A | A | A | A |

Details of materials indicated by (*1)–(*3) in Tables 2–5 are as follows.
(*1)BR-11 manufactured by JSR Corporation
(*2)Percumyl D manufactured by NOF Corporation
(*3)Hi-milan 1706 and Hi-milan 1605 manufactured by Dupont-Mitsui Polychemicals Co., Ltd., blended at a ratio of 50 to 50 by mass (4) Test Result Golf balls of Examples 1–12 have respective cores in which the Mg vulcanized rubber powder and Zn vulcanized rubber powder are blended, while the golf ball of Comparative Example 1 has its core without vulcanized rubber composition, golf balls of Comparative Examples 2 and 3 each have the core including the Zn vulcanized rubber powder only, and the golf ball of Comparative Example 4 has its core including the Mg vulcanized rubber powder only. Golf balls of Examples 1–12 are thus superior to those of Comparative Examples 1–4 in that respective cores of the former golf balls exhibit a relatively good mold release property and there is almost no deterioration in the resiliency of the golf balls.

In terms of the mold release property, golf balls of Examples 1–4, 6, 7 and 9–12 each have the core in which the ratio between the content of the Mg vulcanized rubber powder and the content of the Zn vulcanized rubber powder is in the range from 1/4 to 4 and thus are superior in the mold release property of the core to the golf ball of Example 5 with the core in which the ratio between the Mg vulcanized rubber powder and Zn vulcanized rubber powder is 1/5. In terms of the resiliency, the golf balls of Examples 1–4, 6, 7 and 9–12 are also superior in the resiliency to the golf ball of Example 8 with the core in which the ratio between the Mg vulcanized rubber powder and Zn vulcanized rubber powder is 5/1.

Moreover, the golf balls of Examples 1–10 each have the core in which the total contents of the Mg vulcanized rubber powder and the Zn vulcanized rubber powder based on 100 parts by mass of a base rubber is 5 to 30 parts by mass, and thus the golf balls of examples 1–10 are superior in the mold release property to the golf ball of Example 11 with the core in which the total content of the vulcanized rubber powders is 1 part by mass, and further superior in the kneading workability to the golf ball of Example 12 with its core in which the total contents of the vulcanized rubber powder is 35 parts by mass.

According to the present invention as heretofore discussed, a golf ball and a method of manufacturing thereof are provided, the golf ball having an improved mold release property without deterioration in the resiliency of the golf ball.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A golf ball having a core containing a vulcanized rubber powder crosslinked by a magnesium salt of an unsaturated carboxylic acid and a vulcanized rubber powder crosslinked by a co-crosslinking agent other than the magnesium salt of the unsaturated carboxylic acid.

2. The golf ball according to claim 1, wherein the ratio $\alpha/\beta$ between the content $\alpha$ of said vulcanized rubber powder crosslinked by the magnesium salt of the unsaturated carboxylic acid and the content $\beta$ of said vulcanized rubber powder crosslinked by the co-crosslinking agent other than the magnesium salt of the unsaturated carboxylic acid is 1/4 to 4, and the total content $\alpha+\beta$ of said vulcanized rubber powders based on 100 parts by mass of a base rubber of the core is 5 to 30 parts by mass.

3. The golf ball according to claim 1, wherein said vulcanized rubber powder crosslinked by the magnesium salt of the unsaturated carboxylic acid contains, based on 100 parts by mass of a base rubber, 5 to 40 parts by mass of magnesium methacrylate, 1 to 50 parts by mass of at least one of tungsten, tungsten oxide and barium sulfate, and 0.1 to 5 parts by mass of organic peroxide.

4. A method manufacturing a golf ball as recited in claim 1, said vulcanized rubber powder crosslinked by the magnesium salt of the unsaturated carboxylic acid and said vulcanized rubber powder crosslinked by the co-crosslinking agent other than the magnesium salt of the unsaturated carboxylic acid being blended to produce the core.

* * * * *